US010369606B2

(12) United States Patent
Frost et al.

(10) Patent No.: US 10,369,606 B2
(45) **Date of Patent: *Aug. 6, 2019**

(54) TEMPERATURE ADJUSTMENT STATION AND METHOD FOR OPERATING THE TEMPERATURE ADJUSTMENT STATION

(71) Applicant: BENTELER AUTOMOBILTECHNIK GMBH, Paderborn (DE)

(72) Inventors: Georg Frost, Steinheim (DE); Martin Hesselmann, Willebadessen (DE); Markus Kettler, Paderborn (DE); Max Niesse, Borchen (DE)

(73) Assignee: BENTELER AUTOMOBILTECHNIK GMBH, Paderborn (DE)

( * ) Notice: Subject to any disclaimer, the term of this patent is extended or adjusted under 35 U.S.C. 154(b) by 177 days.

This patent is subject to a terminal disclaimer.

(21) Appl. No.: 15/378,951

(22) Filed: Dec. 14, 2016

(65) Prior Publication Data

US 2017/0165731 A1 Jun. 15, 2017

(30) Foreign Application Priority Data

Dec. 15, 2015 (DE) ..... 10 2015 121 842

(51) Int. Cl.

| | |
|---|---|
| ***B21D 22/02*** | (2006.01) |
| ***B21C 51/00*** | (2006.01) |
| ***B21D 22/20*** | (2006.01) |
| ***C21D 1/673*** | (2006.01) |
| ***B21D 37/16*** | (2006.01) |
| *C21D 9/48* | (2006.01) |

(52) U.S. Cl.
CPC ..... *B21C 51/00* (2013.01); *B21D 22/022* (2013.01); *B21D 22/208* (2013.01); *B21D 37/16* (2013.01); *C21D 1/673* (2013.01); *C21D 9/48* (2013.01)

(58) Field of Classification Search
CPC ..... B21D 22/022
See application file for complete search history.

(56) References Cited

U.S. PATENT DOCUMENTS

| | | | | |
|---|---|---|---|---|
| 2,551,224 | A * | 5/1951 | Spierer | H03K 3/55 307/112 |
| 3,753,798 | A | 8/1973 | Komatsu et al. | |
| 2011/0283851 | A1 | 11/2011 | Overrath et al. | |

(Continued)

FOREIGN PATENT DOCUMENTS

| | | | |
|---|---|---|---|
| DE | 2003305 | A1 | 7/1970 |
| DE | 102013021264 | A1 | 7/2014 |

(Continued)

OTHER PUBLICATIONS

Office Action in CN Application No. 201611149050.1, dated Jul. 13, 2018, 15pp.

*Primary Examiner* — Scott R Kastler
(74) *Attorney, Agent, or Firm* — Hauptman Ham, LLP

(57) ABSTRACT

The present invention relates to a temperature adjustment station for the contact heating of a blank and to a method for operating the temperature adjustment station. According to the invention, the contact pressure exerted on the blank is regulated or controlled in the temperature adjustment station such that linear expansion of the blank does not have a negative effect on the contact plate itself.

9 Claims, 6 Drawing Sheets

(56) References Cited

U.S. PATENT DOCUMENTS

Figure 1:
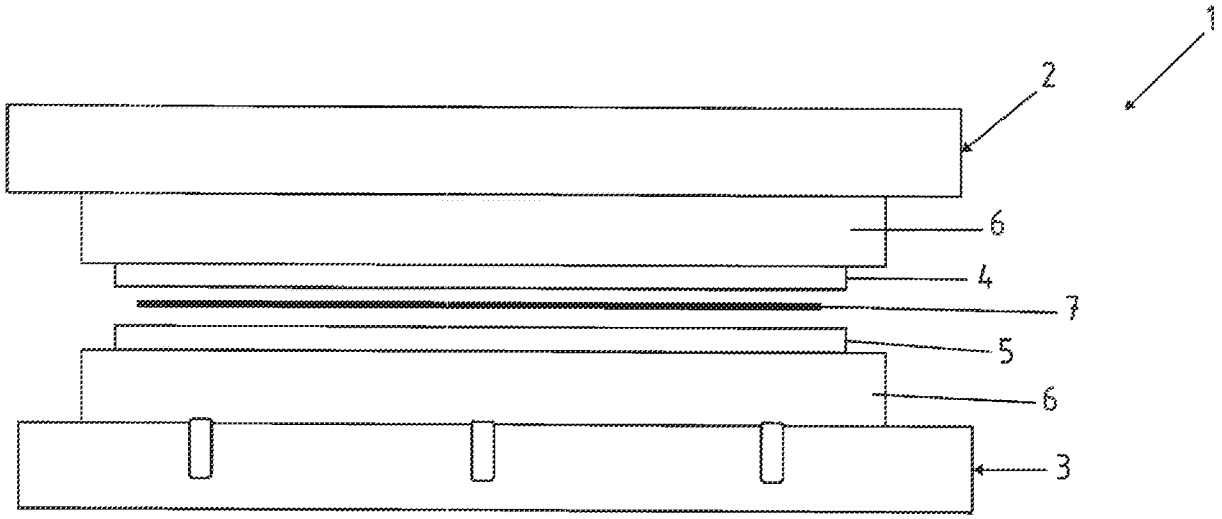

| | | | | |
|---|---|---|---|---|
| 2013/0196275 | A1 | 8/2013 | Schwartz | |
| 2016/0228934 | A1* | 8/2016 | Frost | B21D 22/208 |
| 2017/0066030 | A1* | 3/2017 | Frost | B21D 37/16 |
| 2017/0165731 | A1* | 6/2017 | Frost | B21C 51/00 |

FOREIGN PATENT DOCUMENTS

| | | | |
|---|---|---|---|
| DE | 102014006763 | A1 | 2/2015 |
| DE | 102014101539 | A1 | 8/2015 |
| EP | 2439289 | A1 | 4/2012 |
| EP | 2554288 | A1 | 2/2013 |
| WO | 2007013279 | A1 | 2/2007 |
| WO | 2017020888 | A1 | 2/2017 |

* cited by examiner

TEMPERATURE ADJUSTMENT STATION AND METHOD FOR OPERATING THE TEMPERATURE ADJUSTMENT STATION

RELATED APPLICATIONS

The present application claims priority from German Application No. 10 2015 121 842.9, filed Dec. 15, 2015, the disclosure of which is hereby incorporated by reference herein in its entirety.

The present invention relates to a temperature adjustment station.

The present invention furthermore relates to a method for operating a temperature adjustment station.

Hot forming and press hardening technology is known from the prior art. In this connection, blanks are heated at least in regions, in particular completely, to a temperature above the hardening temperature. Said temperatures are at approx. 700° C., generally 900° C. or higher, depending on the steel alloy used.

After the heating, the blank is formed in the hot state and subsequently hardened in turn by rapid cooling.

Various methods for heating such a blank are known from the prior art. Continuous furnaces are frequently used.

However, temperature adjustment stations having contact heating have increasingly become known in recent times. For this purpose, a contact plate is applied at least on one side to that region of the blank which is to be heated or to the entire blank and the heat of the contact plate is output to the blank by means of heat conduction. As a result of the heating, the blank expands in particular in a direction parallel to the surface of the contact plate. Owing to the bearing contact with the contact plate, this thermal expansion leads in large scale production to plastic deformation of the contact plate. Furthermore, stresses are introduced at least in the region of the surface of the blank to be heated.

It is therefore the object of the present invention to improve the possibilities of the contact heating of a blank.

The abovementioned object is achieved by a temperature adjustment station for the contact heating of a blank.

The method part is furthermore achieved by a method for operating the temperature adjustment station.

The temperature adjustment station for the contact heating of a blank is used in order to heat said blank to a temperature above the room temperature. In particular, the target temperature of the blank is more than 500° C., very particularly preferably more than the hardening temperature, consequently more than 700° C., in particular more than 900° C. The blank may be heated in regions, but is preferably also heated completely.

For this purpose, the temperature adjustment station has an upper die and a lower die, wherein a contact plate for the contact heating is provided at least on the upper die and/or on the lower die. After the blank is inserted, upper die and lower die are closed, and therefore, when the temperature adjustment station is closed, a contact pressure is exerted on the blank, the temperature of which is to be adjusted or which blank is to be heated. According to the invention, said contact pressure which is exerted when the temperature adjustment station is closed can now be regulated or can be controlled. By this means, it is possible according to the invention for the static friction between blank to be heated and contact plate to be able to be optimized or minimized by means of the regulation or control in such a manner that a change in length or width of the blank that occurs as a result of the contact heating does not lead to a change in length or to an irreversible growth of the contact plate.

Consequently, the blank being heated can slide past the contact plate because of the low static friction, with, however, at the same time the contact pressure being adjusted or controlled in such a manner that sufficient heat conduction from contact plate to blank takes place. As an advantage according to the invention, a blank heated in a manner free from stress can be heated economically in terms of the method within a short cycle time, wherein at the same time in large scale production the wear of the contact plate as a result of thermal expansion of the blank is minimized.

The at least one contact plate is preferably designed as an elongate contact plate. This means within the context of the invention that said contact plate has at least a length which corresponds to twice the width. However, for example, a plurality of contact plates can also be arranged next to one another on a die; preferably, two or three elongate contact plates are arranged in parallel next to one another.

Within the context of the invention, the contact pressure exerted on the blank, the temperature of which is to be adjusted, when the temperature adjustment station is closed is regulated or controlled in particular depending on the contact surface between contact plate and blank and/or the cross-sectional area of the contact plate and/or the yield strength $Rp_{0.2}$ (of the contact plate) and/or the actual temperature (of the contact plate) and/or the coefficient of adhesion (coefficient of friction) between contact plate and blank. The contact pressure is particularly preferably regulated or controlled depending on the following formula:

$$p < \frac{Rp_{0.2}(T) * AQ_{Plate}}{AK_{Blank} * \mu}$$

However, the contact pressure can also be calculated and then the temperature adjustment station adjusted in such a manner that the calculated contact pressure is present. However, sensors may also be provided in the temperature adjustment station and then the previously calculated contact pressure can be regulated during the heating operation. The contact pressure is preferably greater than zero.

It is therefore possible to adjust the temperature of uncoated blanks, in particular composed of a steel alloy, for example a boron-manganese steel. Within the context of this invention, adjusting the temperature crucially means heating. However, at the same time, regions can also be cooled or else kept to a temperature, whereas adjacent regions are heated. However, it is likewise possible with the invention to adjust the temperature of coated blanks, for example having an anticorrosion coating, in particular an aluminum-silicon coating.

The heating of the at least one contact plate takes place in particular with one of the heating sources mentioned below. In the form of inductive heating, and therefore the contact plate is inductively heated by the use of an inductor and then in turn the blank is heated by means of heat conduction. The contact plate can also be heated by means of burner heating. The contact plate is thus heated by a burner on the side facing away from the blank and thus heats the blank by means of heat conduction. It is likewise possible to perform the heating as resistance heating. For this purpose, it is either provided that the contact plate itself is designed as a resistor and heats itself upon application of a voltage. However, indirect resistance heating can also be carried out, and therefore heat conductors or heating cartridges are heated on account of their resistor and these heat the contact plate. The heating of the blank takes place in turn by heat conduction from the contact plate to the blank.

The contact plate itself is preferably coupled to the upper die via at least one movable bearing. In the case of a contact plate which is coupled to the lower die, said contact plate is likewise preferably coupled to the lower die via at least one movable bearing. An expansion of the contact plate as a result of the heating of same itself can therefore be compensated for by the movable bearing. Buckling of the contact plate is thereby avoided.

So that the contact pressure exerted on the blank to be heated when the temperature adjustment station is closed can now be changed over the course of the regulation or control, this can take place in two preferred ways.

Either the main drive of the temperature adjustment station is used only for carrying out the closing movement or opening movement of the temperature adjustment station. Even in the closed state, the contact pressure exerted on the blank can be changed via the main drive. In addition or alternatively, additional actuators or control units can be provided which change the contact pressure exerted on the blank when the temperature adjustment station is closed. The temperature adjustment station is therefore initially closed when the blank is inserted. The setting and also the regulation and/or control of the contact pressure then take place via the actuators. The latter may be operated in particular pneumatically, electrically or hydraulically.

In a further preferred variant embodiment of the invention, the contact pressure can be set differently in two at least locally adjacent regions. The contact pressure can preferably therefore be regulated or controlled differently in regions. If a blank, for example, is not heated at all in regions or is heated to a lower temperature than a region of the blank that is adjacent thereto, the contact pressure can thus preferably be set differently in the two regions which differ from each other. In particular, contact plates which differ from one another are then provided, and therefore the contact pressure can preferably be adjusted or can be controlled individually for each contact plate. The contact pressure on a contact plate can therefore be set differently in regions, or use may be made of a plurality of contact plates which are adapted to a contact pressure differing from one another.

The present invention furthermore relates to a method for operating a temperature adjustment station with at least the features mentioned at the beginning, wherein, according to the invention, when the temperature adjustment station is closed, the contact pressure exerted on the blank is regulated or controlled. Within the context of the invention, the contact pressure may also be referred to here as an application pressure. The latter is preferably regulated or controlled with the method according to the invention according to the following formula:

$$p < \frac{Rp_{0.2}(T) * AQ_{Plate}}{AK_{Blank} * \mu}$$

The symbols here have the following meanings: p is the contact pressure, $Rp_{0.2}$ is the yield strength 0.2 of the contact plate (T) depending on the temperature, $AQ_{Plate}$ is the cross-sectional area of the contact plates, $AK_{Blank}$ is the surface of the blank and μ is the coefficient of adhesion. The surface of the blank corresponds to the contact surface between blank and contact plate.

Figure 2:
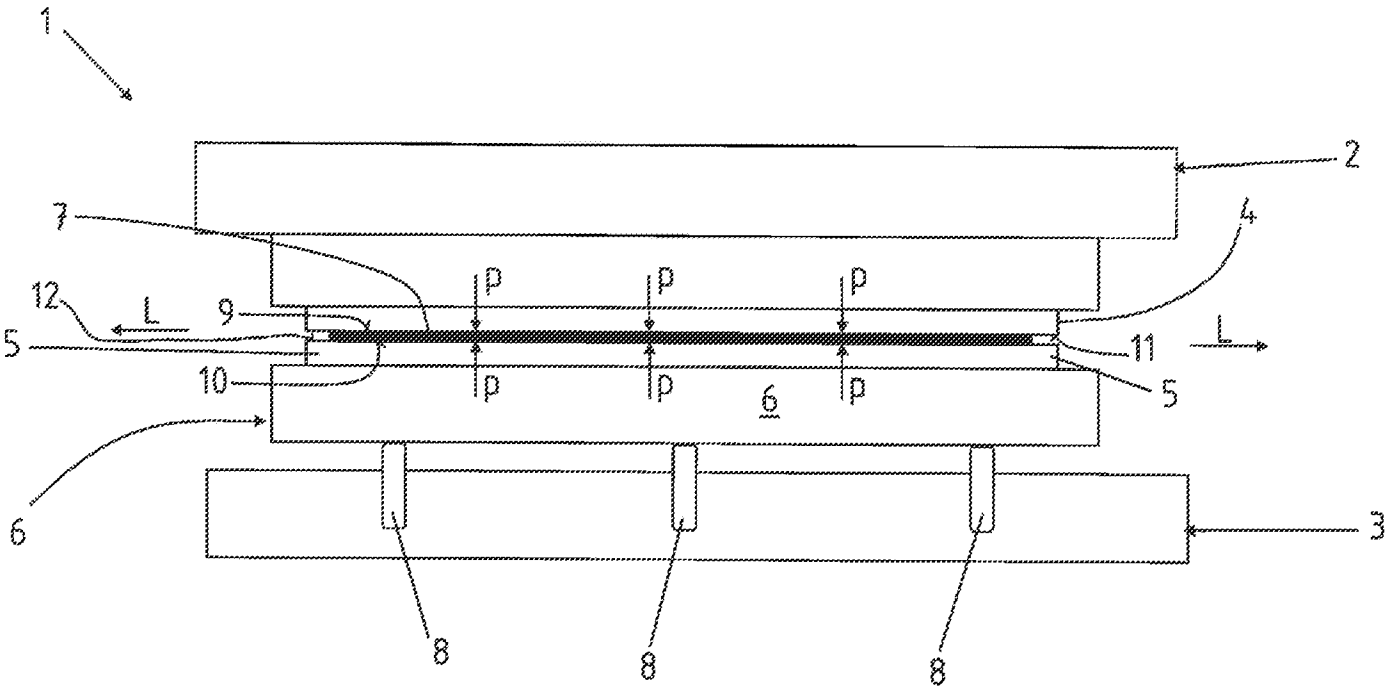
Figures 3A, 3B, 3C, 3D:
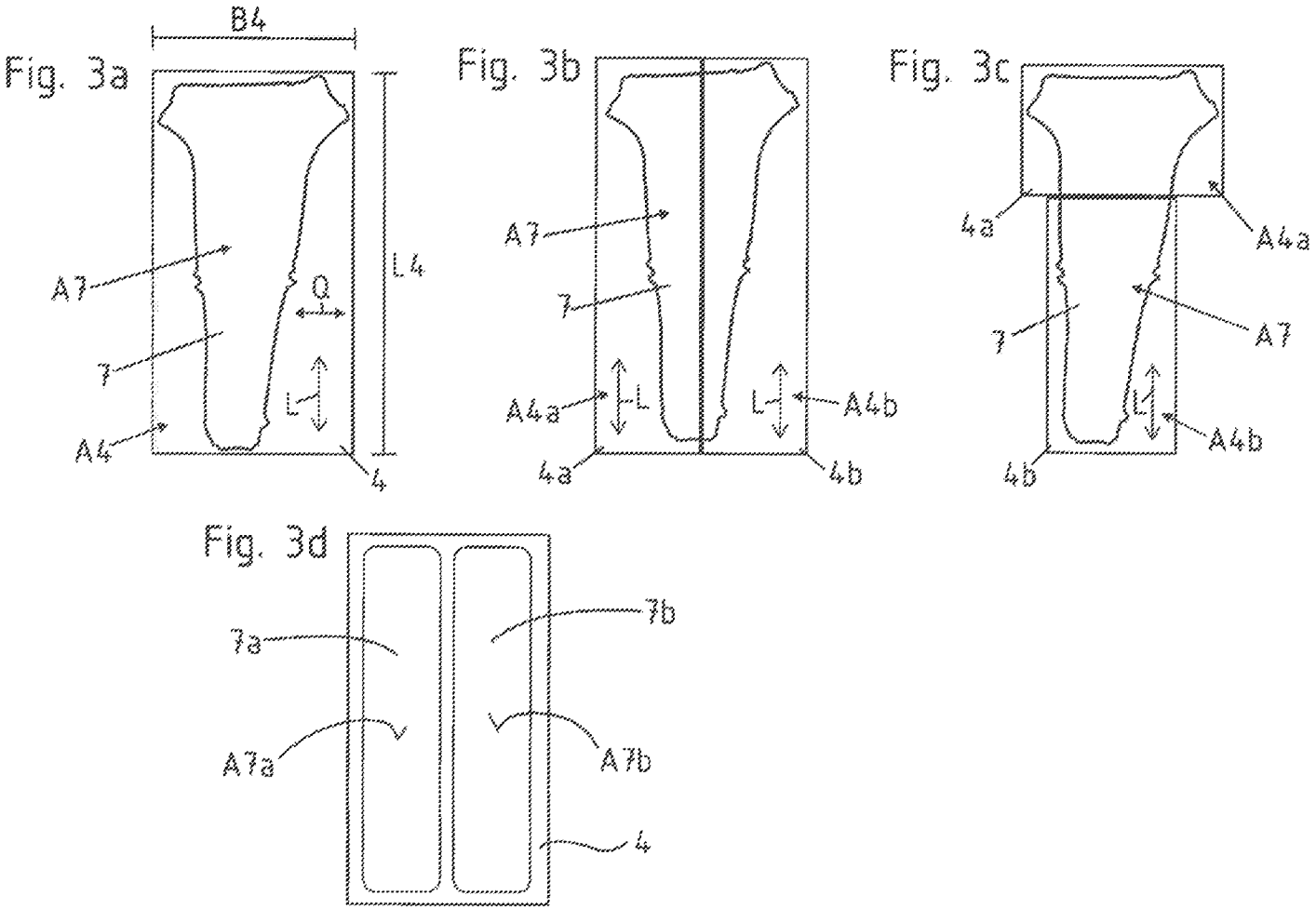
Figure 4:
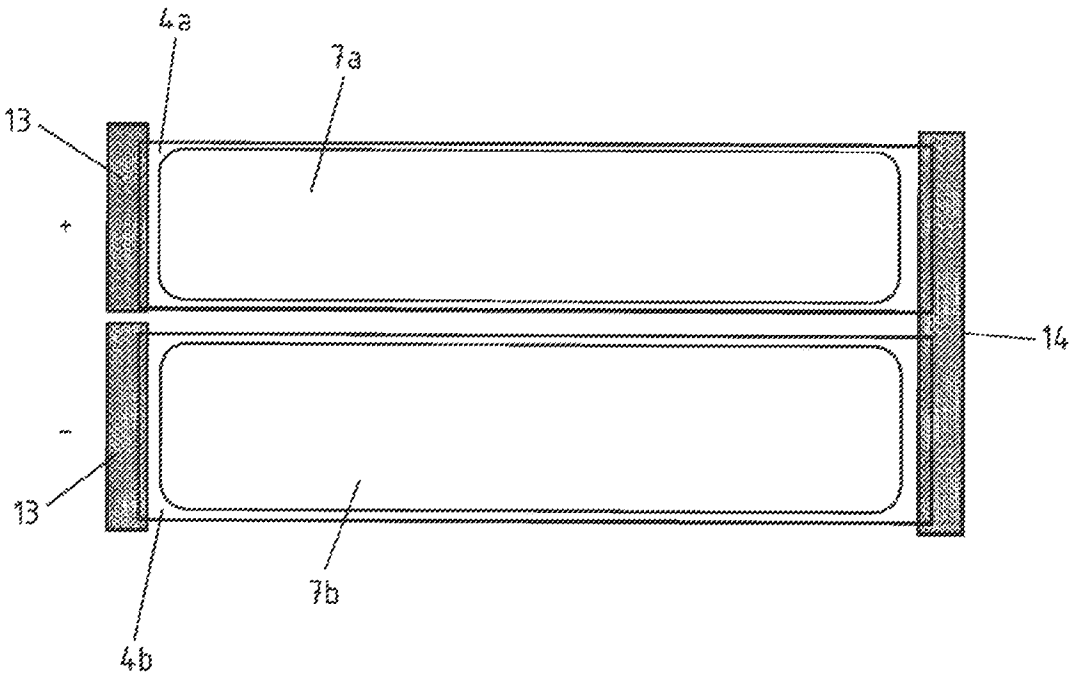
Figure 5:
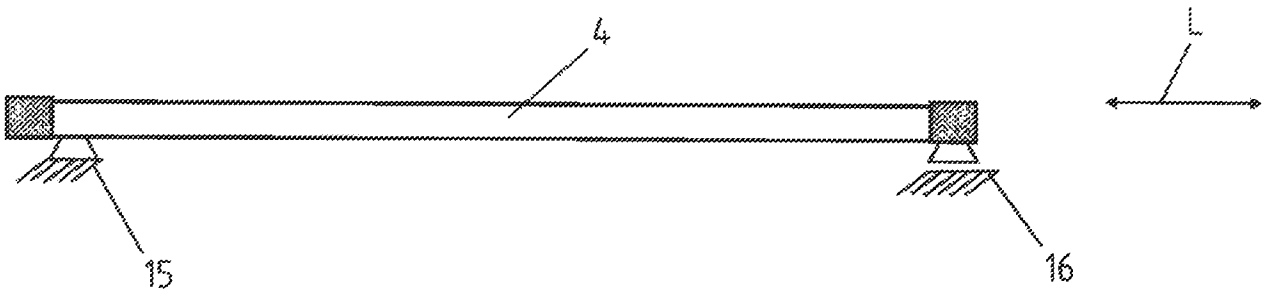
Figure 6:
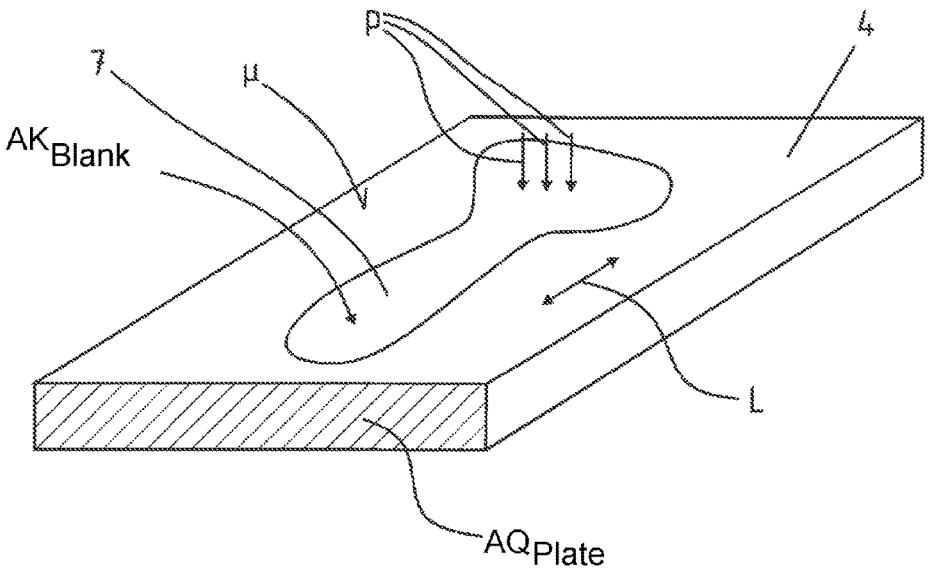

Further advantages, features, properties and aspects of the present invention are part of the description below. Preferred variant embodiments are illustrated in the schematic figures. The latter serve for simple understanding of the invention. In the figures:

FIG. 1 shows the temperature adjustment station according to the invention in the open state in a side view, FIG. 2 shows the temperature adjustment station in a closed view of FIG. 1, FIGS. 3*a* to 3*d* show the contact plates with blank to be heated resting thereon, in a top view, FIG. 4 shows two elongate contact plates lying in parallel next to each other, in a top view, FIG. 5 shows a contact plate with a fixed and movable bearing in a side view, and FIG. 6 shows an illustration of the symbols.

In the figures, the same reference signs are used for identical or similar components, although a repeated description is omitted for simplicity reasons.

FIG. 1 shows a temperature adjustment station 1 according to the invention in a side view, having an upper die 2 and a lower die 3. Furthermore, a contact plate 4 is provided on the upper die 2 and an insulating plate 5 illustrated here in the lower die 3. However, contact plates 4 may also be arranged both on the upper die 2 and on the lower die 3, or a contact plate 4 may be arranged on the lower die 3 and an insulating plate 5 on an upper die 2.

Furthermore, upper die 2 and lower die 3 each also have a baseplate 6, wherein the contact plate 4 or insulating plate 5 is fastened to the baseplate 6. In particular, the contact plates 4 or insulating plates 5 can be coupled interchangeably, in particular can be coupled releasably, and therefore easy changing-over to different sizes of blank to be heated is possible. A blank 7 to be heated is placed in between.

According to FIG. 2, the temperature adjustment station 1 illustrated in FIG. 1 is closed. The closing movement is carried out here by the lower die 3. Actuators 8 are provided here which in this case raise the baseplate 6 and the insulating plate 5. The blank 7 therefore lies substantially over the full surface area with its upper side 9 against the contact plate 4 and with its lower side 10 against the insulating plate 5. A contact pressure p is exerted here between the contact surface 11 of the contact plate 4 and the contact surface 12 of the insulating plate 5 and also between the respective upper side 9 and the lower side 10 of the blank 7. In the example illustrated here, the contact pressure p is identical at all points. However, the contact pressure p may differ in strength in regions in particular in the case of two contact plates 4 and/or insulating plates 5 that are separate from each other with respect to the vertical direction and are arranged next to each other. According to the invention, the contact pressure p is regulated or controlled via the actuators 8 in the closed state, and therefore, depending in particular on the temperature, an optimum contact pressure p is applied and in particular a linear expansion of the blank 7 in the longitudinal direction L does not also lead as it were to a linear expansion of the contact plate 4 and/or insulating plate 5. The blank 7 can therefore carry out a movement relative to the contact plate 4 as a consequence of a thermal expansion in the longitudinal direction L.

FIGS. 3*a* to 3*d* show four differing variant embodiments of contact plates 4, 4*a*, 4*b*. Figures a, b and c each show a blank 7 as a pre-cut blank, and therefore the surface A7 of the blank 7 is smaller than the surface A4 of the contact plate 4, 4*a*, 4*b*. The variant embodiment according to FIG. 3*a* shows a contact plate 4 which correspondingly has a surface A4 of the contact plate 4. In particular, the length L4 of the contact plate 4 is greater than the width B4 of the contact plate. According to FIG. 3*b*, two contact plates 4*a* and 4*b* are provided. Said contact plates each also have a surface A4*a* or A4*b*. According to FIG. 3*c*, two contact plates 4*a* and 4*b* are likewise provided. A respective linear expansion of the blank 7 in the longitudinal direction L is compensated for according to the invention in such a manner that said blank carries out a movement in the longitudinal direction L relative to the contact plate 4/the contact plates 4*a*, 4*b*. In all of the embodiments mentioned in this document, a relative movement can also take place in the transverse direction Q.

According to the variant embodiment of FIG. 3*d*, a contact plate 4 on which two blanks 7*a* and 7*b* simultaneously rest is illustrated. Said blanks have a surface A7*a* and A7*b*. Such blanks 7*a*, 7*b* are used in particular for producing door impact supports. The temperature of two blanks 7*a*, 7*b* can therefore be adjusted simultaneously in the temperature adjustment station according to the invention.

According to FIG. 4, the example from FIG. 3*d* is illustrated once again. The contact plate is formed from two contact plates 4*a* and 4*b* in the form of resistance heating, and therefore a voltage can be applied via a connection of electrical poles 13 such that the contact plates 4*a*, 4*b* themselves heat up. A current flow through the contact plates 4*a*, 4*b* is ensured via an electrical connection 14. Two blanks 7*a*, 7*b* are placed thereon.

FIG. 5 shows the contact plate 4 in a side view. The mounting is undertaken here on the one side with a fixed bearing 15 and on the opposite side with a movable bearing 16, and therefore, because of the fixed and movable bearing assembly, a linear expansion of the contact plate 4 in the longitudinal direction L as a consequence of thermal heating is likewise permitted.

FIG. 6 shows a contact plate 4 with a blank 7 placed thereon. The cross-sectional area $AQ_{Plate}$ and the surface $AK_{Blank}$ can readily be seen here. A coefficient of adhesion μ is then present between the blank 7 and the contact plate 4. The contact pressure p which arises according to the invention by the contact plate 4 pressing against another contact plate 4 (not illustrated specifically) or against an insulating plate 5, in particular with the blank 7 being included, is illustrated by way of example.

REFERENCE SIGNS

1—Temperature adjustment station
2—Upper die
3—Lower die
4—Contact plate
4*a*—Contact plate
4*b*—Contact plate
5—Insulating plate
6—Baseplate
7—Blank
7*a*—Blank
7*b*—Blank
8—Actuator
9—Upper side of 7
10—Lower side of 7
11—Contact surface of 4
12—Contact surface of 5
13—Electrical pole
14—Electrical connection
15—Fixed bearing
16—Movable bearing
A4—Surface of 4
A4*a*—Surface of 4*a*
A4*b*—Surface of 4*b*
A7—Surface of 7
A7*a*—Surface of 7
A7*b*—Surface of 7
B4—Width of 4
L—Longitudinal direction
L4—Length of 4
p—Contact pressure
Q—Transverse direction
$AK_{Blank}$—Surface of 7
$AQ_{Plate}$—Cross-sectional area of 4, 4*a*, 4*b*
μ—Coefficient of adhesion between 4 and 7

The invention claimed is:

1. Temperature adjustment station for the contact heating of a blank, for the at least partial hardening of the blank, having an upper die and a lower die, with at least one contact plate, wherein the contact pressure exerted on the blank, the temperature of which is to be adjusted, is regulated or controlled when the temperature adjustment station is closed, wherein a contact plate is coupled to the upper die via at least one movable bearing, and/or a contact plate is coupled to the lower die via at least one movable bearing.

2. Temperature adjustment station according to claim 1, wherein the contact plate is designed as an elongate contact plate, wherein the contact plate has a length which corresponds at least to 1.2 to 2 times the width.

3. Temperature adjustment station according to claim 1, further comprising a main drive and/or actuators to regulate the contact pressure depending on a contact surface and/or a cross-sectional area of the contact plate and/or a yield strength of the contact plate and/or a coefficient of adhesion and/or an actual temperature.

4. Temperature adjustment station according to claim 1, wherein at least one of the following heating sources: inductive heating, burner heating or resistance heating, is provided for heating the at least one contact plate.

5. Temperature adjustment station according to claim 1, wherein, in the case of resistance heating, the contact plate as the resistor is heated itself, or the contact plate is configured to be heated via heat conductors or heating cartridges.

6. Temperature adjustment station according to claim 1, wherein the change in the contact pressure as a result of the regulation or control is performed by a main drive of the temperature adjustment station, and/or actuators are provided for changing the contact pressure.

7. Temperature adjustment station according to claim 1, wherein the contact pressure is set differently in at least two locally adjacent regions.

8. Method for operating a temperature adjustment station according to claim 1, wherein, when the temperature adjustment station is closed, the contact pressure exerted on the blank is regulated or controlled.

9. Method according to claim 8, wherein the contact pressure is regulated or controlled according to the following formula:

$$p < \frac{Rp_{0,2}(T) * AQ_{Plate}}{AK_{Blank} * \mu}$$

* * * * *